US008656842B1

(12) United States Patent
McDonley

(10) Patent No.: US 8,656,842 B1
(45) Date of Patent: Feb. 25, 2014

(54) WALL MOUNTED PORTABLE DESK

(71) Applicant: Daniel Patrick McDonley, San Francisco, CA (US)

(72) Inventor: Daniel Patrick McDonley, San Francisco, CA (US)

( * ) Notice: Subject to any disclaimer, the term of this patent is extended or adjusted under 35 U.S.C. 154(b) by 0 days.

(21) Appl. No.: 13/694,748

(22) Filed: Dec. 31, 2012

(51) Int. Cl.
*A47B 23/00* (2006.01)

(52) U.S. Cl.
USPC ..... 108/42; 108/164; 108/149

(58) Field of Classification Search
USPC ..... 108/42, 47, 48, 166–167, 171, 180, 108/182, 134–135, 152, 164, 149; 211/90.01, 113, 118
See application file for complete search history.

(56) References Cited

U.S. PATENT DOCUMENTS

| | | | | | |
|---|---|---|---|---|---|
| 1,487,475 | A * | 3/1924 | Ribyat | 5/94 |
| 2,115,323 | A * | 4/1938 | Wuest | 108/149 |
| 3,799,072 | A * | 3/1974 | Slaboden | 108/107 |
| 3,904,258 | A * | 9/1975 | Faulkenberry | 312/6 |
| 4,187,787 | A * | 2/1980 | Nakatsu | 108/96 |
| 4,523,526 | A * | 6/1985 | O'Neill | 108/149 |
| 5,176,266 | A * | 1/1993 | Gillet | 211/90.04 |
| 5,427,344 | A * | 6/1995 | Beauchemin | 248/218.4 |
| 5,570,642 | A * | 11/1996 | Lehrman | 108/47 |
| 6,116,164 | A * | 9/2000 | Justen, Jr. | 108/42 |
| 6,354,232 | B1 * | 3/2002 | Hulke | 108/149 |
| 6,637,609 | B2 * | 10/2003 | Stevens | 211/118 |
| 6,814,418 | B2 * | 11/2004 | D'Orso | 312/351 |
| 7,810,655 | B2 * | 10/2010 | Wang | 211/118 |
| 8,356,720 | B2 * | 1/2013 | Mathews | 211/90.02 |
| 2012/0079965 | A1 * | 4/2012 | Gentry et al. | 108/42 |
| 2012/0097629 | A1 * | 4/2012 | Brisendine | 211/96 |

FOREIGN PATENT DOCUMENTS

| | | | | |
|---|---|---|---|---|
| FR | 2648335 | A1 * | 12/1990 | A47B 57/26 |

* cited by examiner

*Primary Examiner* — Hanh V Tran

(57) ABSTRACT

A wall mounted portable desk where a first shelf and a second shelf are supported by hanging straps. The straps are hung on a wall by hooks and attached D rings. The straps are inserted through and folded over the rings creating a pair of front and rear straps. Each shelf has loop type fastening strips extending from each corner. The hanging straps each have one surface covered with hook type fastening material. The front shelf strips attach to the attach to the hook fastener side of the front folded hanging straps. The rear shelf strips attach to the rear hook fastening side of the rear hanging straps. The front folded hanging straps proceed to the underside of the first shelf and a slide into a support ring and then proceed down to the front edge of the second shelf and finally under the second shelf and onto the hook portion of the rear folded hanging strap.

5 Claims, 10 Drawing Sheets

WALL MOUNTED PORTABLE DESK

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of portable wall hung furniture and more specifically to a wall mounted portable desk.

Shelves and desks are well known furniture items found in most homes and work environments. Generally, shelves are either stand alone constructions that are usually placed in close proximity to a wall, or are fastened directly to a wall, usually by attaching vertical brackets to the wall and then attaching horizontal brackets to the vertical brackets, which in turn hold a shelf or shelves. Desks are generally stand alone pieces of furniture that can be placed in any location within a room or up against a wall. In recent years the concept of a standing desk has gained popularity because the user can retain improved posture and health by standing while working rather than slumped in a chair. Generally, standing desks are rather expensive to purchase and therefore a person new to the concept may be hesitant to invest in one. Additionally, many people who travel would like to have the advantage of the use of a standing desk while in their hotel rooms. Furthermore, many people like the concept of minimal furniture and would like the ability to quickly and easily install shelves or a standing desk on a wall in their home or office. To this end it would be ideal to have an inexpensive, height adjustable standing desk or shelf system that uses flexible hanging straps and foldable shelves to create a shelf or desk assembly.

Several strap hanging shelf systems have been designed and patented in the past. These include patents U.S. Pat. No. 4,187,787 by Daniel Nakatsu and U.S. Pat. No. 4,523,526 by Hugh O'Neill. Although these designs use straps to hang shelves on the wall they have several deficiencies.

First, they are not easily height adjustable. Second the shelves are not foldable for compact storage.

BRIEF SUMMARY OF THE INVENTION

The primary object of the invention is to provide a wall mounted portable desk that allows a user to quickly and easily hang components that form a desk and/or shelf onto a vertical surface such as a wall or door.

Another object of the invention is to provide a wall mounted portable desk that can be stored flat in a small enclosure that can fit in an air travel type suitcase.

Another object of the invention is to provide a wall mounted portable desk whose shelves can be easily height adjusted to any height.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a wall mounted portable desk comprising: a first strap, a second strap, a first shelf, a second shelf, a first D hanging ring, a second D hanging ring, a pair of strap hanging hooks, said first and second strap each including of a polyester front side and a hook type fastener rear side, said first and second shelves each including a pair of rigid panels placed side by side and enclosed by a fabric sheath and being foldable for compact storage and retaining their side by side rigid condition by the addition of a pair of parallel disposed stiffening rods trapped within sewn on tubular retaining strips located on the underside of said shelves, said stiffening rods each made of a first and second half rod, one end of said first half rod capable of connecting into a mating end of said second half rod, said half rods each removably and replacebly held together by a bungee cord, said first and second shelves each having a pair of loop type fastening straps extending out from their rear edge and a pair of loop type fastening straps extending from the front edge of each shelf, said first and second shelves also each having underside strap retaining rings mounted on either end of the underside surface of said shelf, said strap hanging hooks mounted to a wall or door, said first and second D hanging rings hung from said trap hanging hooks, said first and second straps inserted into said first and second D hanging rings forming a pair or rear hanging straps and a pair of forward hanging straps, said first and second shelves attached to said rear hanging straps by said rear shelf loop type fastening strips attaching to said loop type fasting strap of said rear hanging strap and said front shelf loop type fastening straps attaching to said hook type forward hanging strap, and said front hanging straps proceeding under said first hanging shelf and sliding through said underside strap retaining rings and then proceeding down to the front edge of said second shelf and proceeding under said second shelf and finally attaching to the hook type fastening strip of the rear said rear hanging strip.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
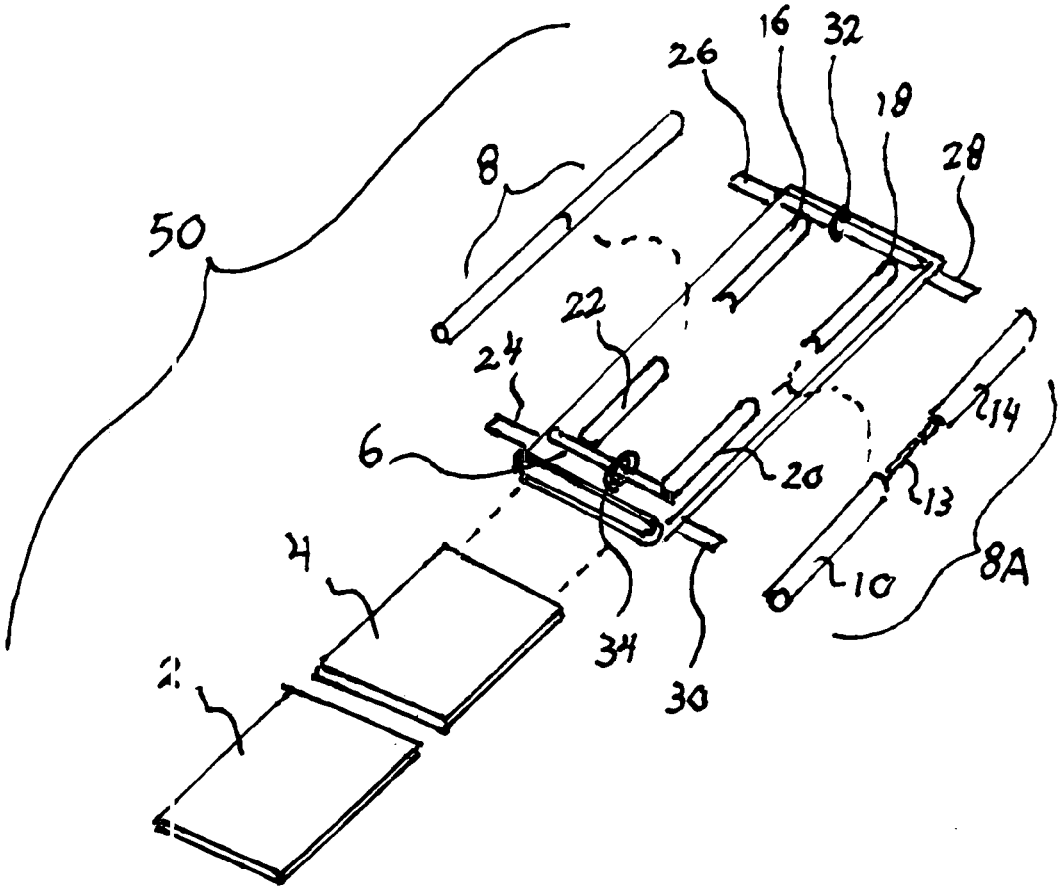
FIG. 1 is an exploded view of a shelf assembly of the present invention.
Figure 3:
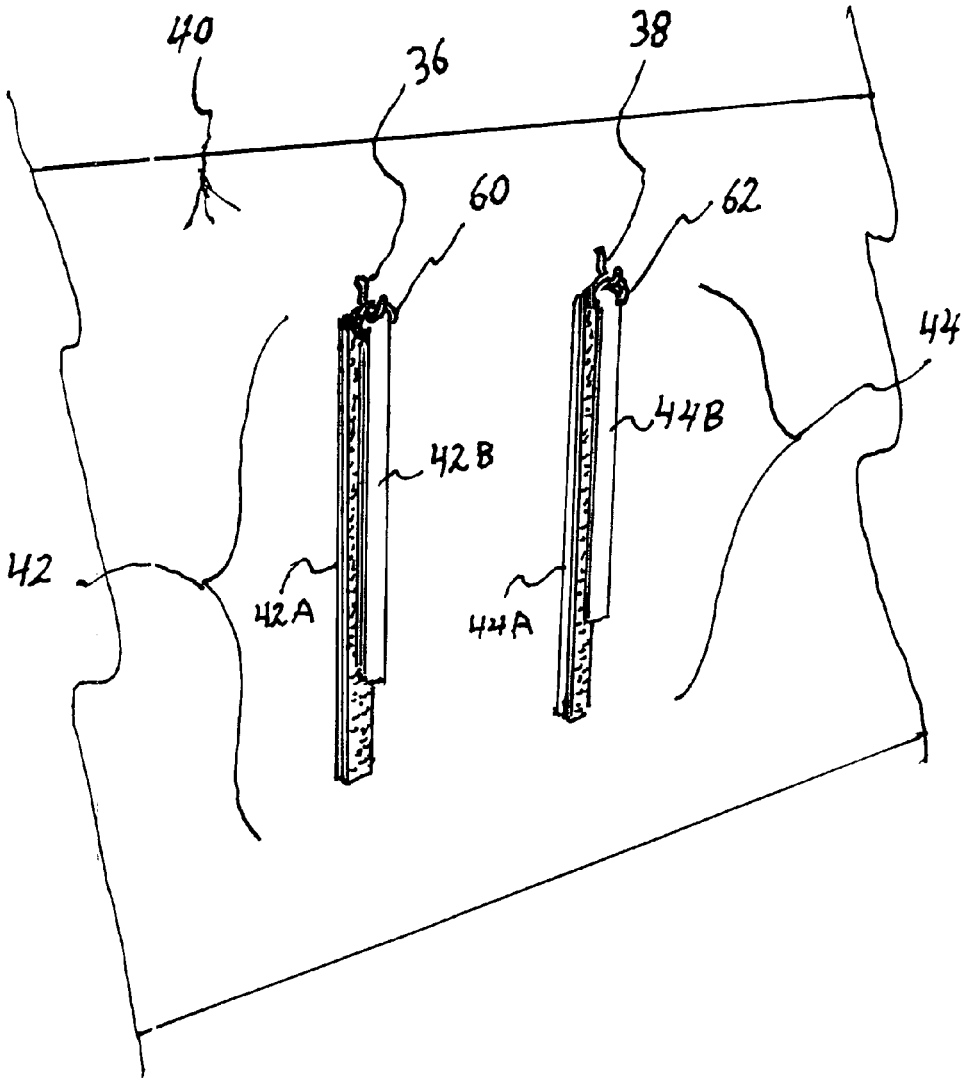
FIG. 3 is a perspective view of the hanging straps of the present invention.

Referring now to FIG. 1 we see an exploded view of the underside of a typical shelf assembly 50. Two rigid panels 2, 4 are placed side by side and inserted into a fabric sheath 6. The rigid panels 2, 4 can be made of plastic, wood or metal. The space between the panels 2, 4 forms a hinge area once inserted into the sheath 6. The fabric 6 acts as the hinge. The underside of the sheath 6 includes rod retaining pockets 20, 22, 16, 18. A rigid rod 8 is slid into the pockets 12, 16. For compact storage, the rod 8 is made of two lengths 10, 13 of rigid rod material such as light weight aluminum, steel or wood, and connected by an elastic length of bungee cord 13, similar to the way a tent support pole is constructed as shown in the rod 8A. Strap sliding retaining rings 32, 34 help hold the hanging straps 42, 44, as shown in FIG. 3, at the proper location, as will be described below, to help force the shelf 50 towards the wall 40 that it is hung on, and thereby create a more stable desk and shelf design. Sewn on strips 30, 28, 24, 26 are made of loop type fastening material and help hold the shelf assembly 50 to the hanging straps 42, 44 as will be explained below.

Figure 2:
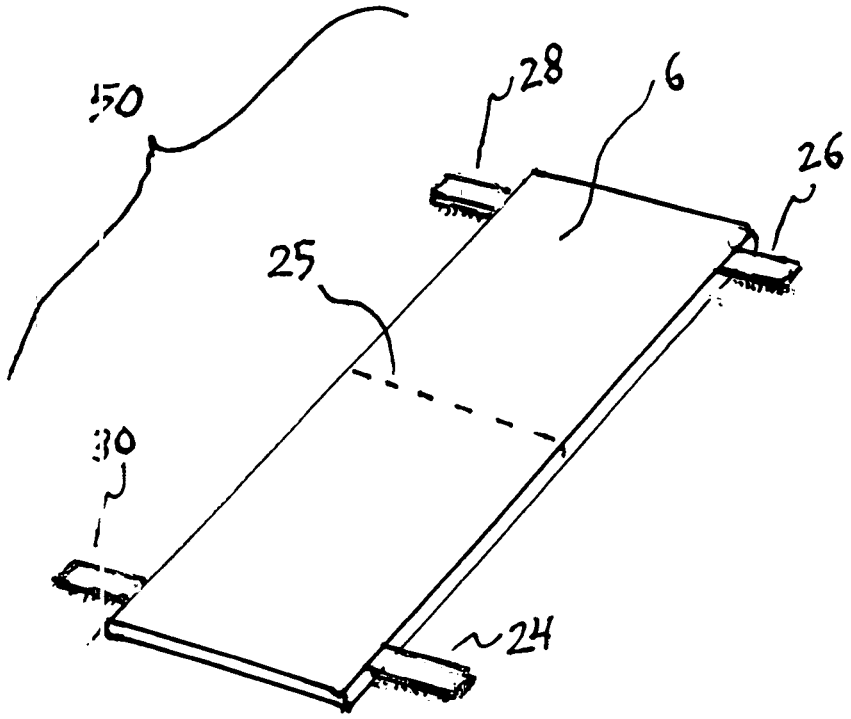
FIG. 2 is a perspective view of a shelf of the present invention.

FIG. 2 is a top perspective view of a shelf assembly 50. Dotted line 25 represents the hinge point, allowing the two halves of the shelf to be folded for compact storage and transport. This configuration, along with the folding rods 8 allows the entire hanging desk assembly 100 to be carried in a small case and taken on an airplane as carry-on luggage, enabling the user to set up the hanging desk 100 at a remote location such as a hotel room or temporary office.

FIG. 3 is a perspective view of the hanging straps 40, 42 of the present invention in place on a wall 40. The straps 40, 42 each have a polyester fabric side and a hook type fastener material sewn onto the opposite side. The straps 42, 44 are hung on the wall by hooks 36, 38. These hooks can be wallboard type hooks that can be installed without any tools, or, in a permanent location, can be screw type hooks that screw into studs within the wall 40. Alternately, the hooks can be inverted J type hooks that fit over the top edge of a door. D rings 60, 62 are hung on the hooks 36, 38 and the straps 42, 44 are threaded through the D rings 60, 62. The straps now form a pair of front straps 42B, 44B and a pair of rear straps 42A, 44A.

Figure 4:
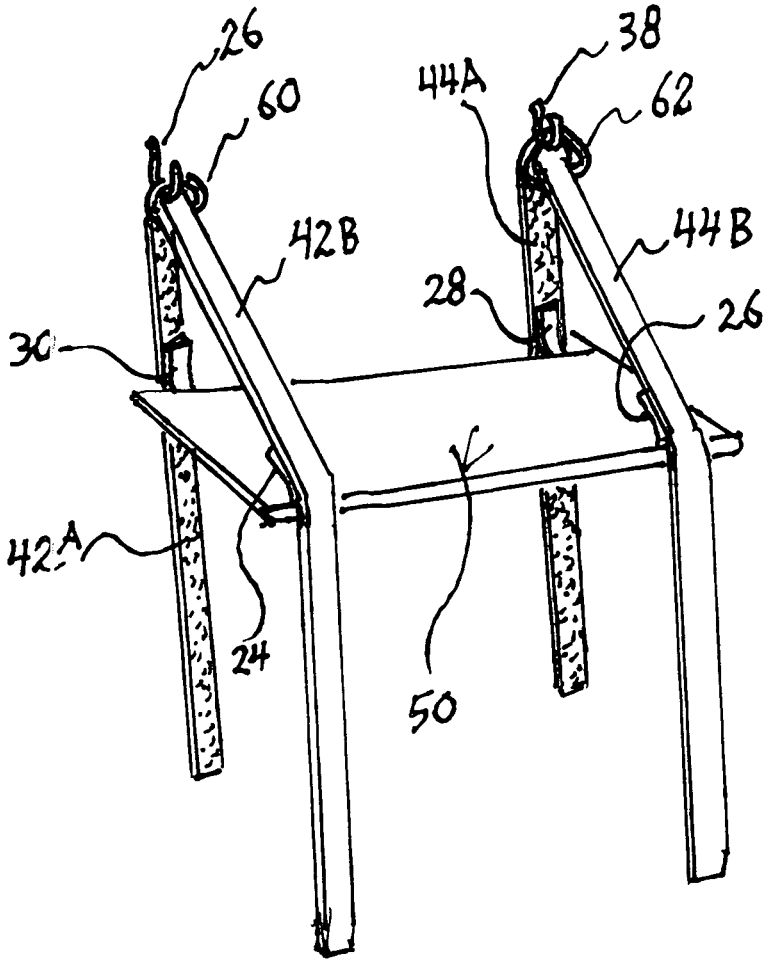
FIG. 4 is a perspective view of one shelf installed.
Figure 7:
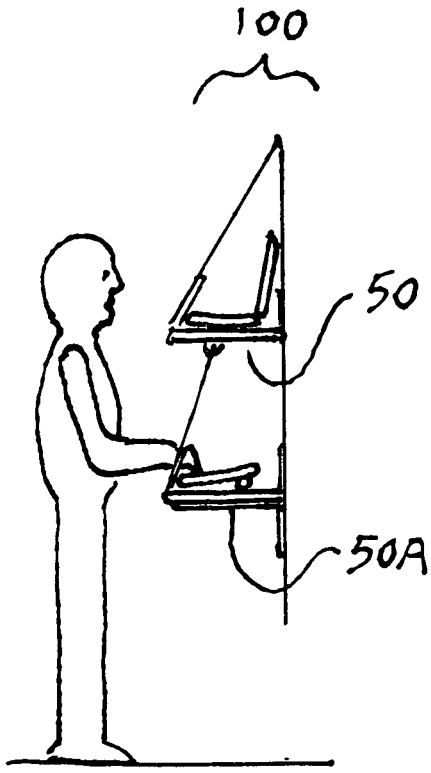
FIG. 7 is a side view of a person using the invention holding a laptop computer and a separate keyboard while in the standing position.
Figure 8:
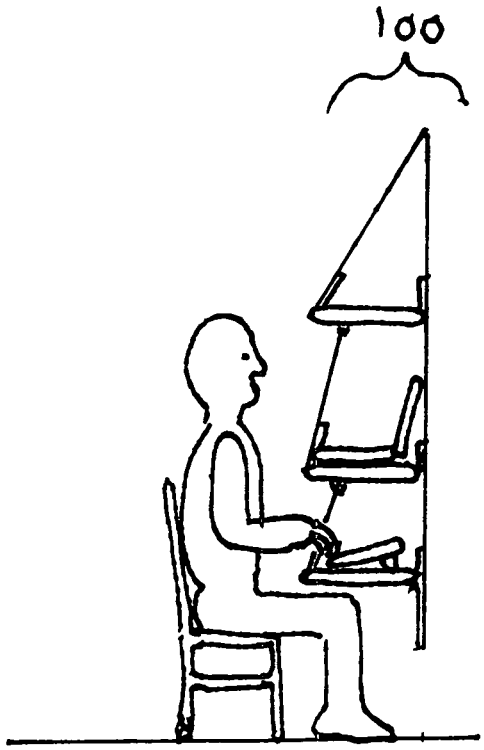
FIG. 8 is a side view of a person using the invention in the sitting position.
Figure 9:
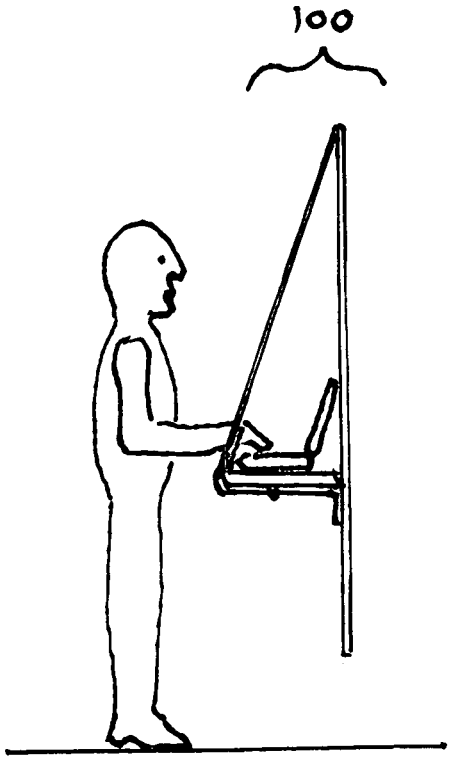
FIG. 9 is a side view of a person using the invention holding a laptop an a single shelf while in the standing position.

FIG. 4 is a perspective view of the top shelf 50 being attached to the straps 42, 44. The rear loop type strips 30, 28 have been attached to the hook type material found on rear hanging straps 42A, 44A. The front loop type strips 24, 26 have been attached to the hook type material found on the back side of front straps 42B, 44B. It should be noted that the loop strips 30, 28, 24, 26 can be mounted anywhere on the front and rear hanging straps 43, 44 and therefore provide a shelf or desk location having infinite variety of heights or surface angles. For example, a person may want to have his or her shelf 50 act as a desk and want the rear portion of the desk to be higher than the front portion. This can be configured by the user in a matter of seconds. Additionally, the height of each shelf assembly 50 can be adjusted in seconds, and thereby give the user the ability to set up the desk or shelves to his or her specific requirements. Several configurations of height adjustment are shown in the side views in FIGS. 7, 8 and 9. These views show the user engaging with a laptop computer and, in FIGS. 7 and 8, a separate keyboard. The setup in FIG. 7 allows the user to stand at his or her desk and have a straight on view of the computer screen, while maintaining the optimum height for the keyboard. FIG. 8 Shows a person who has set up the shelves 50 to be a sitting desk, where the computer screen is also at eye level. FIG. 9 shows a person who has set up the shelf 50 as a desk for use without a separate keyboard and for use in the standing position. This configuration can utilize only one shelf, however a second shelf is shown for storing office materials.

Figure 5:
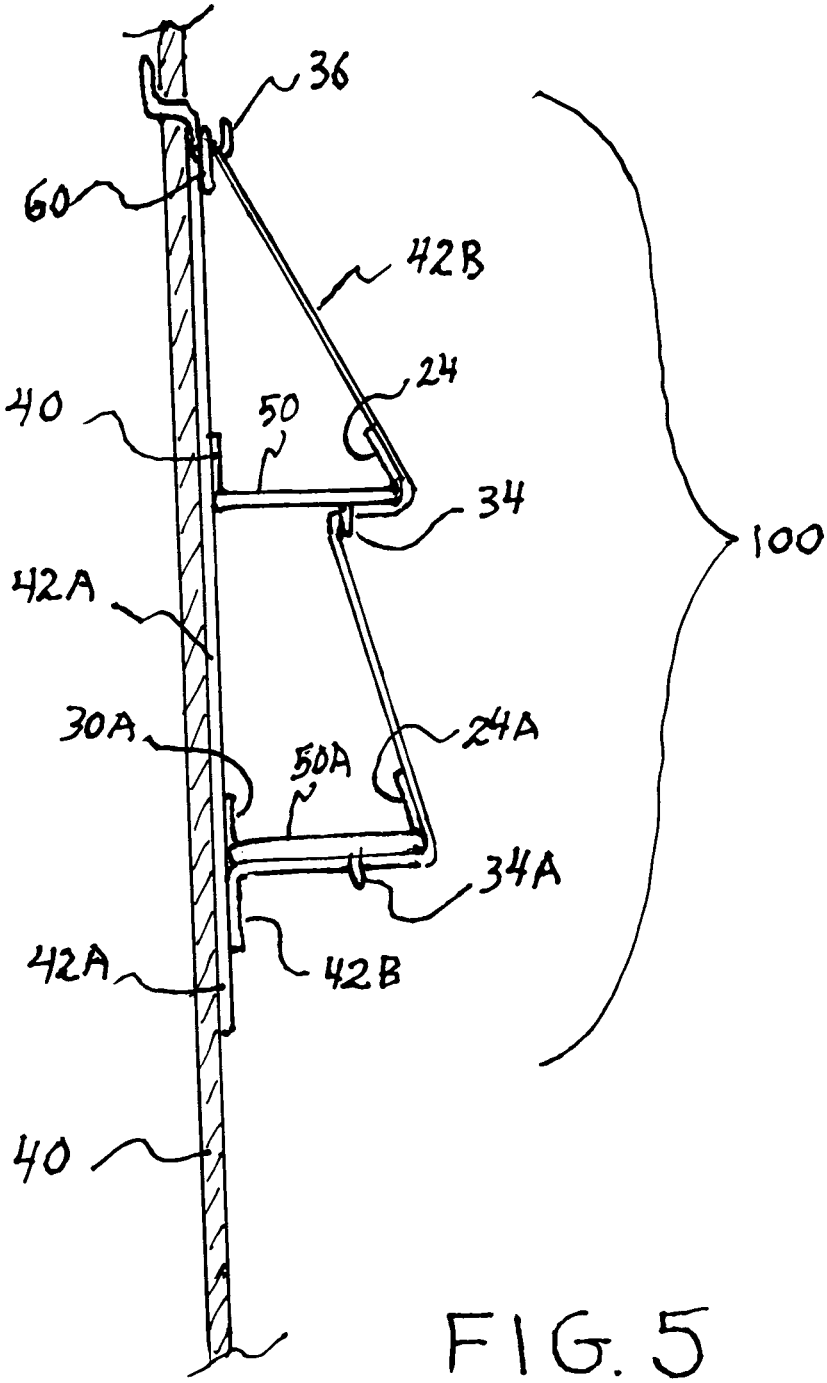
FIG. 5 is a side view of two shelves installed

FIG. 5 is a side view of the entire shelf assembly 100. This view shows how the front straps 42B are slid through underside rings 34 to help hold the shelves in intimate contact with the supporting wall 40. The front hanging strap 42B finally attaches to the rear hanging strap 42A just below the lowest shelf assembly 50A. It should be noted that additionally shelves 50 can be added as needed, as long as the shelf hanging straps 42, 44 are of sufficient length.

Figure 6:
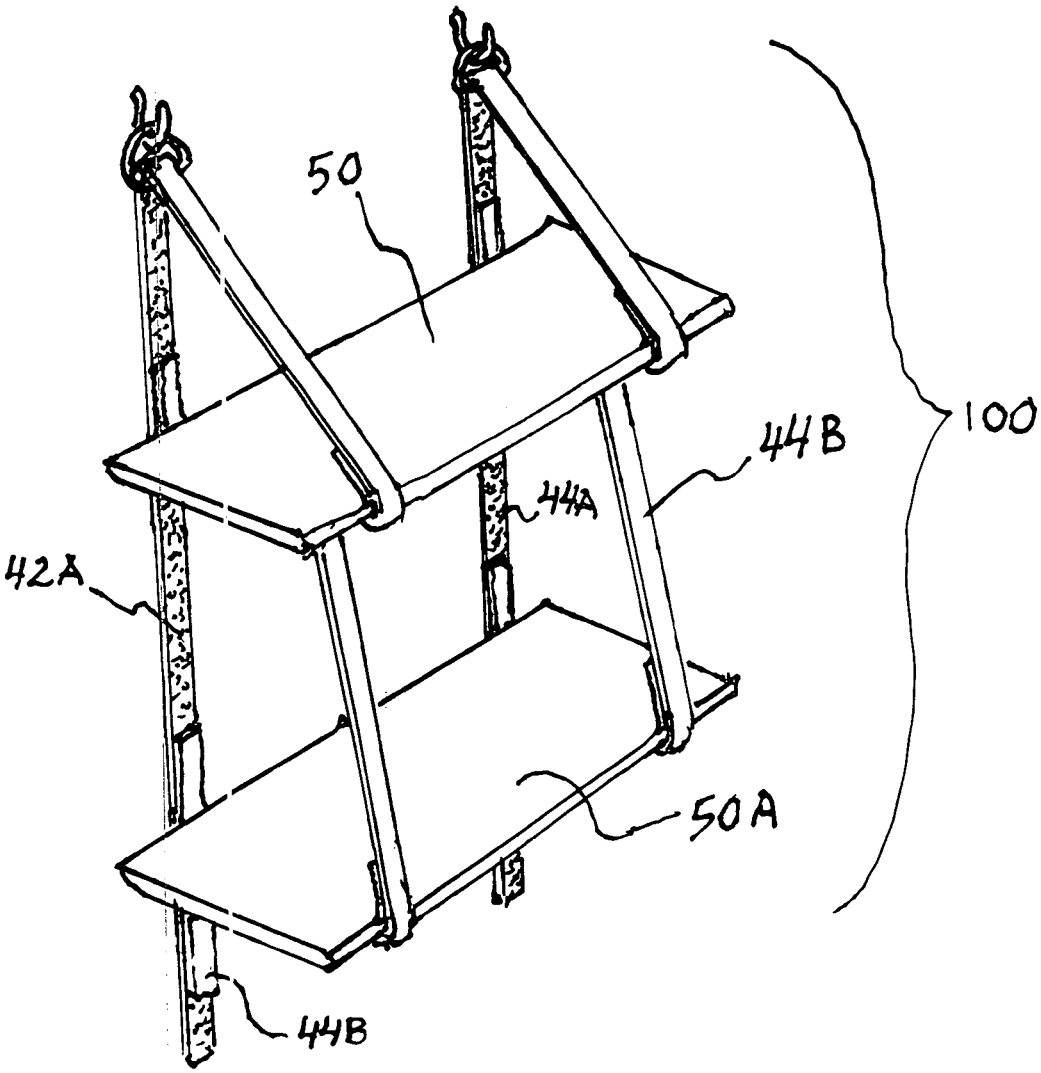
FIG. 6 is a perspective view of two shelves installed

FIG. 6 is a perspective view of the completed hanging desk of the present invention 100. The entire invention 100 is very light weight and portable, yet each shelf can easily hold 30 pounds, which is the weight of a typical large flat screen display. With the present invention 100, a person can set up a standing or sitting desk assembly in a matter of a few minutes with no tools and with complete height and angle adjustability.

Figure 10:
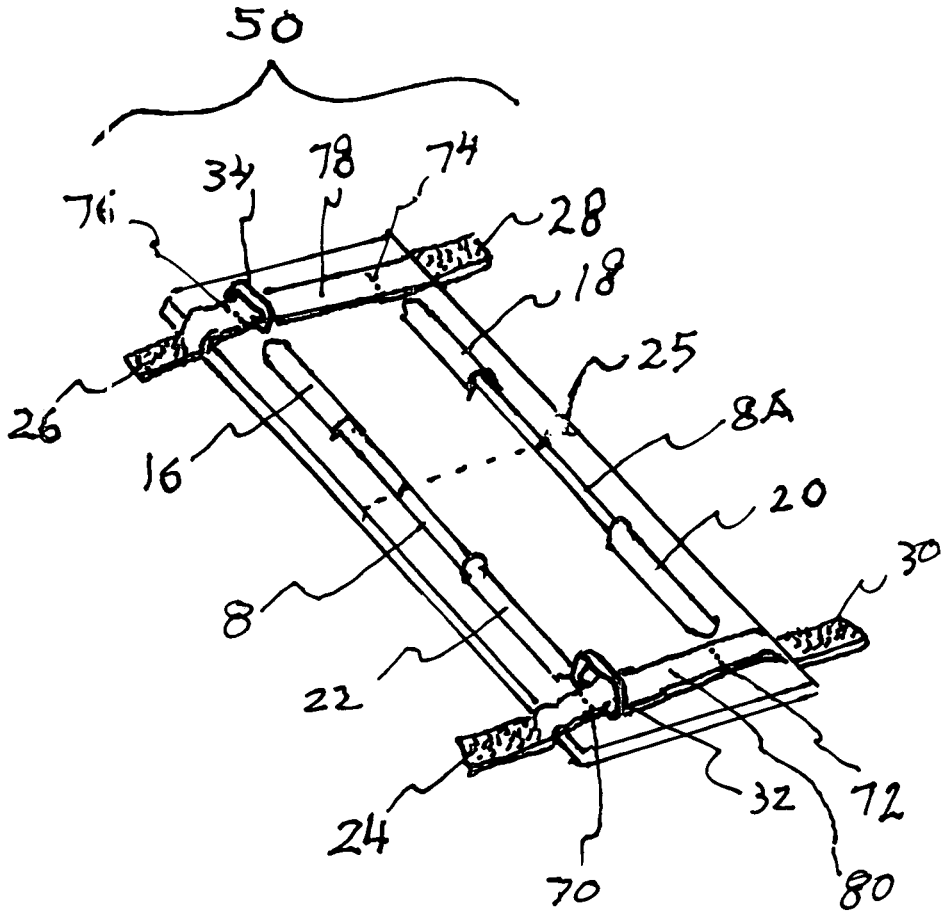
FIG. 10 is an underside view of a shelf.

FIG. 10 is an underside view of a shelf 50. Rods 8, 8A are shown in place in their receiving pockets 16, 18, 20 22. Rods 8, 8A are made of rigid material such as light weight aluminum, steel or wood. Strap retaining rings 32, 34 are capable of sliding along reinforcing strips 78, 80 until they reach sewn stopping points 70, 72 and 74, 76. The stopping points are the correct locations for the rings 32, 34, therefore no matter which way the user installs the shelf, the rings 32, 34 end up in the correct position.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A wall mounted portable desk comprising:

a first strap;

a second strap;

a first shelf;

a first D hanging ring;

a second D hanging ring;

a pair of strap hanging hooks;

said first and second straps each including a fabric front side and a hook type fastener rear side;

said first shelf including a pair of rigid panels placed side by side and enclosed by a fabric sheath and being centrally foldable for compact storage and capable of retaining their rigid side by side condition by the addition of a pair of parallel disposed stiffening rods trapped within sewn on tubular retaining pockets located on the underside of said shelves;

said stiffening rods each made of a first and second half rod;

one end of said first half rod capable of connecting into one end of said second half rod;

said half rods each removably and replacebly held together by an elastic cord;

said first shelf having a pair of loop type fastening straps extending out from the rear corners and a pair of loop type fastening straps extending from the front corners;

said first shelf having an underside strap retaining ring mounted on a respective end of the underside surface of said shelf;

said strap hanging hooks mounted to a vertical support;

said first and second D hanging rings hung from said strap hanging hooks;

said first and second straps inserted into said first and second D hanging rings forming a pair of rear hanging straps and a pair of forward hanging straps;

said first shelf attached to said rear hanging straps by said rear shelf loop type fastening straps attaching to said hook type fastening material of said rear hanging straps and said front shelf loop type fastening straps attaching to said hook type material of said forward hanging straps; and said front hanging straps proceeding under said first hanging shelf and sliding through said underside strap retaining rings and finally configured to attach to the hook type fastening material of said rear hanging strap.

2. A wall mounted portable desk as claimed in claim 1 further comprising a second shelf having the same structure as the first shelf, such that said front hanging straps proceeding under said first hanging shelf and sliding through said underside strap retaining rings and then proceeding down to the front edge of said second shelf and proceeding under said second shelf and finally configured to attach to the hook type fastening material of said rear hanging strap.

3. A wall mounted portable desk as claimed in claim 2, further comprising additional shelves that hang in the same manner as said first and second shelves.

4. A wall mounted portable desk as claimed in claim 1 wherein said strap hanging hooks are over the door type hooks.

5. A wall mounted portable desk as claimed in claim 1 wherein said strap hanging hooks are wall board type hanging hooks.

* * * * *